United States Patent [19]

Carmody et al.

[11] Patent Number: 4,925,221

[45] Date of Patent: May 15, 1990

[54] TOGGLE LATCH WITH AUTOMATIC SAFETY CATCH

[75] Inventors: Timothy A. Carmody, Los Alamitos; William R. Bourne, Jr., Redondo Beach; John Stammreich, Rancho Palos Verdes, all of Calif.

[73] Assignee: VSI Corp., Chantilly, Va.

[21] Appl. No.: 242,021

[22] Filed: Sep. 1, 1988

[51] Int. Cl.[5] ..... E05C 5/02

[52] U.S. Cl. ..... 292/200; 292/DIG. 31; 292/DIG. 49; 292/196

[58] Field of Search ..... 292/113, DIG. 49, DIG. 31, 292/247, 200, 210, 196

[56] References Cited

U.S. PATENT DOCUMENTS

| | | | |
|---|---|---|---|
| 2,927,812 | 3/1960 | Smith et al. | 292/196 |
| 3,515,422 | 6/1970 | Poe | 292/113 |
| 4,538,843 | 9/1985 | Harris | 292/113 |

FOREIGN PATENT DOCUMENTS

| | | | |
|---|---|---|---|
| 749206 | 11/1944 | Fed. Rep. of Germany | 292/196 |

*Primary Examiner*—Richard E. Moore

*Attorney, Agent, or Firm*—Poms, Smith, Lande & Rose

[57] ABSTRACT

A toggle latch is shown which retains a structure, such as an aircraft door, latched against a second structure, such as the fuselage. The latch includes a housing having a latch actuator joined to the housing a first pivot point and a latch member joined to the housing at a second pivot point. A linkage joins the latch actuator and latch member at third and fourth pivot points. In the latched position, the fourth pivot point is positioned past a center line between the first and third pivot points to create the over-center, toggle effect of the latch. A safety catch is pivoted within the latch actuator which extends into a passage in the actuator. The safety catch also engages the housing when the toggle latch is in its latched position to lock the latch closed. Insertion of a tool into the passage engages the safety catch to remove it from its locking contact with the housing and free the latch actuator for opening the latch.

14 Claims, 2 Drawing Sheets

TOGGLE LATCH WITH AUTOMATIC SAFETY CATCH

BACKGROUND OF THE INVENTION

The present invention relates to a toggle latch and, more particularly, to a toggle latch having an automatic safety catch which locks the latch in its toggle position.

Toggle latches have been used in various environments including aircraft for many years. A toggle latch similar to the latch in which the present invention is incorporated has been used in various locations on an aircraft fuselage including in front of engine inlets. Historically, doors closed by toggle latches have been difficult to rig properly to ensure that the doors remain closed. Should a door open in flight, it could be ingested by the aircraft engine, causing shutdown due to foreign object damage. To overcome this accidental opening, the toggle latches have been made adjustable by providing a screw adjustment within the latch member. This permits the toggle latch to place a preload upon the door and frame. However, since the load rigging is left to the mechanic, it is not certain that the adjustment will be correct. Underadjustment will create a gap between the door and frame allowing destructive vibration or airflow to tear the door from the aircraft. Overadjustment of the adjustable screw on the latch bolt can reduce the over-center movement of the toggle latch and even permit the latch to appear to be closed while in an on-center, and thus unlocked, position. This could also create an unsafe condition and result in the door, upon which the latch is used, opening while the aircraft is in flight.

SUMMARY OF THE INVENTION

Accordingly, it is an object of this invention to provide an automatic safety catch for a toggle latch as a backup lock should an on-center or reduced over-center condition occur due to an incorrect adjustment of the toggle latch or incomplete closing the latch.

The improved toggle latch of this invention includes a housing having a latch actuator pivotally mounted upon the housing at a first pivot point. A latch member is also mounted to the housing at a second pivot point. A linkage joins the latch actuator and latch member at third and fourth pivots such that the fourth pivot point is over-center from a line through the first and third pivot points. The latch actuator is provided with an aperture therein which receives a safety catch having camming surfaces thereon, including a first cam surface that is exposed within the aperture and a second cam surface that engages, or interferes with, the housing. The second cam surface may not contact the housing until the latch is moved towards its opening position. A tool inserted into the aperture engages the first cam surface for displacing the safety catch and its second cam surface which disengages from its contact or interference with the housing to permit the opening of the toggle latch.

DESCRIPTION OF THE DRAWINGS

A better understanding of the present invention and of additional advantages and objects will be had after consideration of the specification and drawings, wherein.

DESCRIPTION OF THE PREFERRED EMBODIMENT

Figure 1:
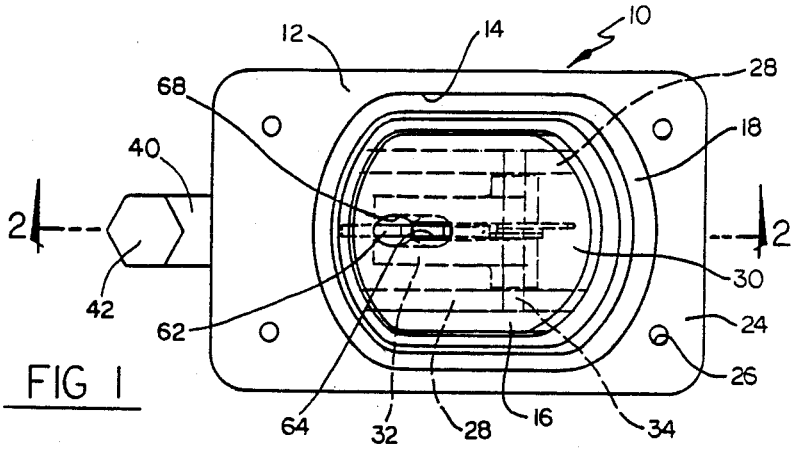
FIG. 1 is a top plan view of the toggle latch of the present invention.
Figure 2:
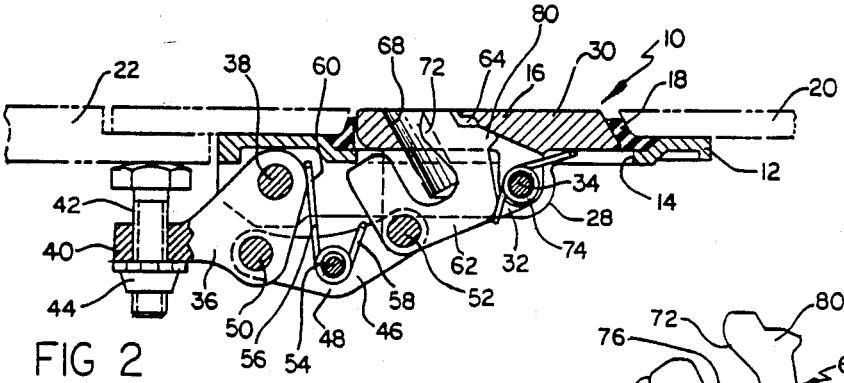
FIG. 2 is a cross-sectional view taken along line 2—2 of FIG. 1.

Referring now to the drawings, FIG. 1 shows a toggle latch 10 having a housing 12 with a centrally located aperture 14 which receives a latch actuator 16 therein. Surrounding the opening 14 and receiving the latch actuator 16 is a gasket 18 made from a suitable elastomeric material which seals the toggle latch 10 against the structural surface of the vehicle in which the latch is used as shown in phantom at 20 in FIG. 2. The structure 20 may be an aircraft door, for example, which fits within a second structure, an aircraft fuselage 22, also shown in phantom in FIG. 2. As seen in FIG. 1, housing 12 has an upper mounting surface 24 that is generally flat or curved to the contour of the vehicle in which it is used into which suitable mounting apertures 26 may be placed for mounting the surface 24 against structure 20, as by fasteners such as rivets, bolts or screws (not shown).

In the preferred embodiment, housing 12 is constructed from a cast member made from a light alloy, such as aluminum. Housing 12 has a pair of ribs 28 which extend along either side of opening 14 and partially close that opening. The latch actuator 16 is also made from a cast, light weight alloy, such as aluminum, with a flat finger pad 30 extending through aperture 14 and arranged to be flush with the outer surface of structure 20. Extending below the finger pad 30 is a central block 32 which fits between ribs 28 and is attached therebetween by a first pivot rod 34 which extends through the ribs 28 and is retained therein by, for example, staking the ends of rod 34.

Attached between the ribs 28 on the opposite end of the housing 12 from latch actuator 16 is a latch member 36 which is attached at a second pivot point by a second pivot rod 38. Latch member 36 includes an extending latch finger 40 that is tapped to threadably receive an adjustable latch bolt 42 which engages the inner surface of structure 22. The latch bolt 42 is secured after adjustment in its desired position by a conventional jam nut 44.

A linkage 46 including a pair of arms 48 (only one of which is shown in the drawings) joins the latch actuator 16 to the latch member 36 at a third pivot point formed by a third pivot rod 50. Rod 50 passes through a first pivot arm 48, through the latch member and then through a second pivot arm (not shown). Similarly, the arms 48 are attached to the latch actuator 16 at a fourth pivot point formed by a fourth pivot rod 52. The linkage 46 is completed by a spring pin 54 which passes between the two arms 48 and around which a spring 56 is wrapped.

It will be seen in FIGS. 2–7 that the spring 56 has a pair of spring arms 58 on each end which extend over the latch arms 48. Inward from the spring arms 58, the spring wraps about pin 54 and, at its center, extends as a U-shaped arm 60 to engage the latch member 36. From a review of FIGS. 2, 5 and 6, it will be seen that the spring is at its maximum compressed position as the toggle latch 10 opens and passes through its over-center position, FIG. 5. On the latched side of the over-center position, FIG. 2, the spring expands to urge the latch member 36 into a latching position. On the other side of the over-center position, FIG. 6, the spring 56 expands to urge the toggle latch 10 into a fully opened over-center position.

The present invention is incorporated into the toggle latch 10 described thus far and is intended as a simple add on device to provide an automatic safety catch which does not rely upon the operator to make sure it is closed.

Figure 3:
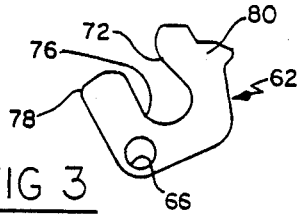
FIG. 3 is a detailed side view of the safety catch of the present invention.

Referring now to FIG. 3, a safety catch 62 is shown. For the reader's convenience, safety catch 62 has been shown in FIGS. 1 and 2. However, safety catch 62 will now be described in more detail with reference to FIGS. 1–4.

Figure 4:
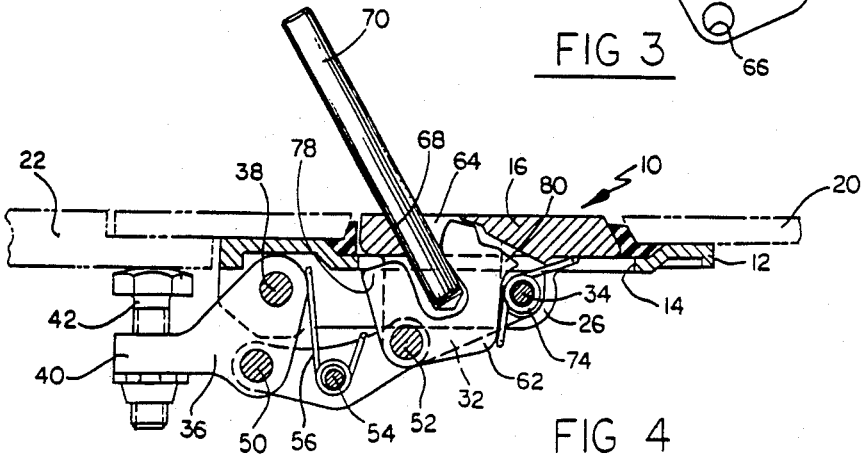
FIG. 4 is a cross-sectional view similar to FIG. 2 showing an operating tool inserted into the toggle latch.

The safety catch 62 mounts within a slot 64, FIG. 1, which passes through the center of the central block 32 of latch actuator 16 and extends toward, and opens into, the outer surface of finger pad 30. The safety catch 62 is retained within slot 64 by an aperture 66 through which the fourth pivot rod 52 passes. As best seen in FIG. 3, the safety catch 62 is a generally U-shaped member which may be stamped from a piece of corrosion-resistant steel, for example. Aperture 66 is located in the lower, left-hand corner of the U-shape. As best seen in FIG. 1, slot 64 extends into a generally circular tool aperture 68 found in the upper surface of the finger pad 30. Aperture 68 forms a passage that receives an opening tool 70, FIG. 4. The tool 70 extends through the aperture 68 for displacing a first cam surface 72 formed on the inner, right-hand leg of the U-shaped safety catch 62. The cam surface 72 is normally urged into the aperture 68 by a spring 74 wrapped about the first pivot rod 34. As the tool 70 engages cam surface 72, it extends into a slot 76 formed between the legs of the U-shaped safety catch 62 to displace the first cam surface 72. Displacement of the cam surface 72 in passage 68 causes the safety catch 62 to rotate about rod 52 in a clockwise direction for removing a second cam surface 78 from its engagement against, or interference with, the underside of the opening 14 within housing 12. The rotation of the catch 62 also removes a stop 80 thereon from its contact against the inner surface of the slot 64, as best seen in FIG. 4. The stop 80 is formed on the outer end surface of the U-shaped safety catch 62, as seen in FIG. 3. Full insertion of the tool 70 into aperture 68 thus automatically removes the safety catch 62 from its locked position.

Figure 5:
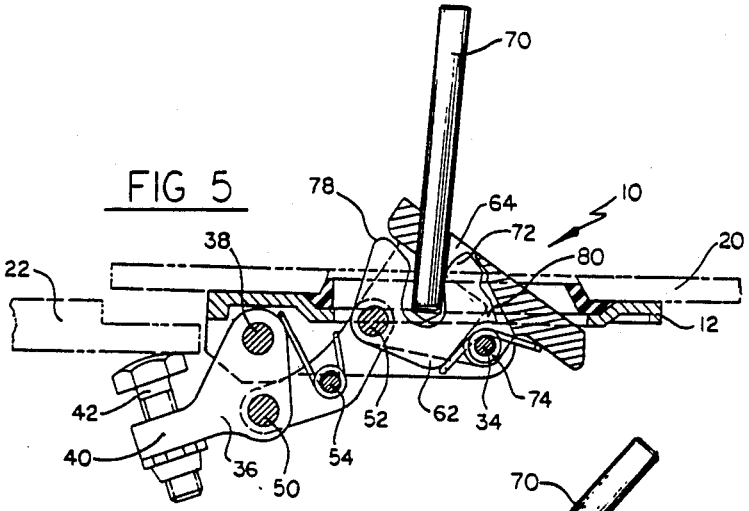
FIG. 5 is a cross-sectional view similar to FIG. 4 showing the toggle latch passing through its over-center position.

Referring to FIG. 4 again, a straight line between the center of the first pivot formed by first pivot rod 34 and the third pivot formed by third pivot rod 50 passes above the fourth pivot formed by fourth pivot rod 52. As the inserted tool 70 is rotated in a clockwise direction, as seen in FIG. 5, the fourth pivot 52 passes from beneath the imaginary line between first pivot 34 and third pivot 50 and over-the-center thereof to remove the toggle latch 10 from its over-center and locked position.

Figure 6:
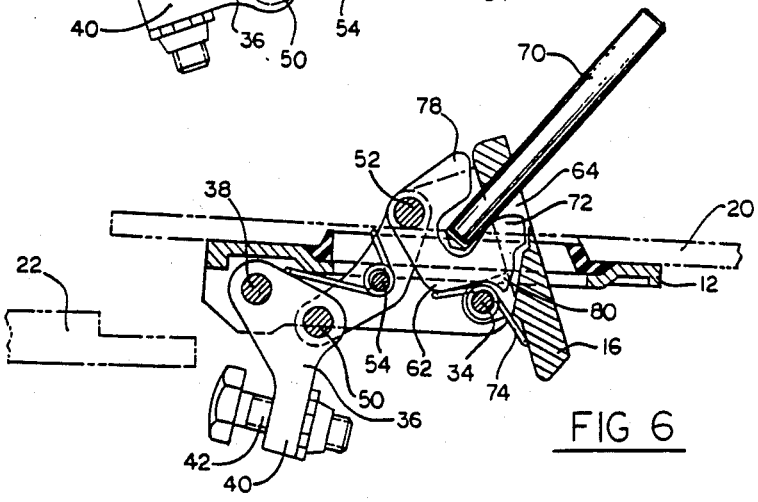
FIG. 6 is a cross-sectional view similar to FIG. 5 showing the toggle latch in its opened position.

Further clockwise rotation of the tool 70 will place the toggle latch 10 in an unlatched position as shown in FIG. 6 to permit the structure 20, such as a door, to be opened and disengage from the structure 22, such as the fuselage of an aircraft.

Figure 7:
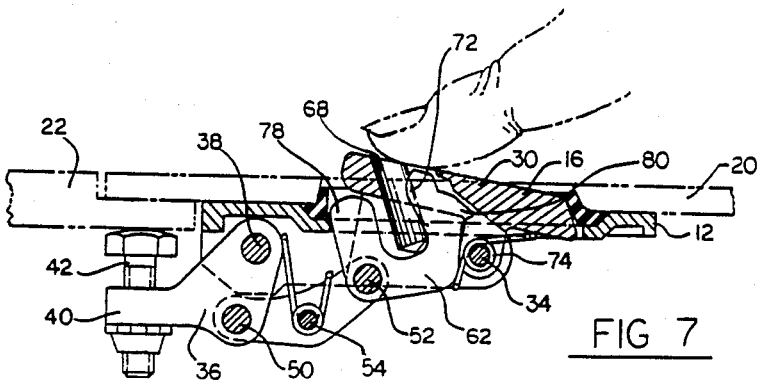
FIG. 7 is a cross-sectional view similar to FIG. 6 showing the toggle latch in a position just prior to being closed, as shown in FIG. 2.

When it is desired to close the toggle latch 10, a finger may be placed upon the finger pad 30 of latch actuator 16 for exerting a sufficient downward pressure to rotate the latch actuator in a counterclockwise direction, FIG. 7. As the adjustable latch bolt 42 comes into engagement with the under surface of the structure 22, the fourth pivot point formed by pivot rod 52 will pass over-center and beneath the center line between the first and third pivot points formed by rods 34 and 50, respectively. As the latch actuator assumes its final latched position, flush with the surface of structure 20, FIG. 2, the second cam surface 78 slips under the lower surface of housing 12 and is urged into a counterclockwise movement by spring 74. This causes the stop 80 to abut the lower surface of slot 64 and causes the first cam surface 72 to move into aperture 68. The position of cam surface 72 in aperture 68 provides a flag to indicate that the safety catch 62 is properly engaged with the latching cam surface 78 against the lower surface of housing 12 and the stop 80 against the lower surface of slot 64 in latch actuator 16. The toggle latch 10 is thus automatically locked by safety catch 62.

It will be understood that the latch 10 can be closed with the tool 70, as well as opened. When the tool 70 is removed from the aperture 68 upon closing, if the latch 10 is in the proper closed position, i.e., the latching mechanism is over-center or in toggle, the safety catch 62 will move into its proper position as indicated by surface 72 in aperture 68.

The reader will understand that the toggle latch of the present invention may be utilized in high vibration applications other than within an aircraft. Further, the precise configuration of the toggle latch 10, its components and the safety catch 62 may vary depending on the environment or structuring in which the toggle latch 10 is mounted. For example, the safety catch 62 could be extended into the area of the latch actuator 16 where the actuator finger pad 30 is provided with a finger depression to expose the safety catch. The placement of a finger into the finger depression would then permit the safety catch to be rotated about rod 52 to open the latch 10. Accordingly, the present invention should be limited only by the appended claims.

We claim:

1. In a toggle latch for retaining a first structure against a second structure, the toggle latch having a housing that pivotally mounts a latch actuator and a latch with a linkage joining said pivotable latch actuator and latch at further pivot points, one linkage pivot point going over-center from the other pivot points to form said toggle, the improvement comprising:

said latch actuator having a slotted aperture therein;

a safety catch mounted within said slotted aperture for engaging said housing in said over-center, latched position; and said slotted aperture configured to allow removal of said safety catch from its engagement with said housing upon contact with said safety catch to permit actuation of said latch actuator thereby unlatching said latch.

2. The toggle latch of claim 1, further comprising: a spring for normally urging said safety catch into said slotted aperture.

3. The toggle latch of claim 1, wherein:
said slotted aperture is configured to receive a tool for engaging and removing said safety catch from its housing engagement.

4. The toggle latch of claim 3, further comprising:
said safety catch having a first cam surface thereon for engaging said tool and a second cam surface thereon for engaging said housing when in said latched position, said first cam surface providing a visual indication of a latched condition.

5. The toggle latch of claim 3, further comprising:
said slotted aperture having a first opening to receive said tool and a second slotted opening joined to said first opening to receive said safety catch.

6. The toggle latch of claim 5, wherein:
said safety catch is slotted to receive said tool.

7. The toggle latch of claim 1, wherein:
said housing is flush with said first and second structure in the closed position of said toggle latch;
said latch actuator is flush with said housing in said closed position; and
said safety catch is flush with said latch actuator in said closed position.

8. A toggle latch for retaining a first structure against a second structure, comprising:
a housing;
a latch actuator joined to said housing at a first pivot;
a latch member joined to said housing at a second pivot;
a linkage joining said latch actuator and said latch member at third and fourth pivots, said fourth pivot being over-center from a line through said first and third pivots when said latch is in its closed position; and
a safety catch mounted within said latch actuator for engaging said housing to prevent said fourth pivot point from moving from its over-center position until said safety catch is opened.

9. The toggle latch of claim 8, further comprising:
said latch actuator having an aperture therein to permit the insertion of a tool for opening said safety catch.

10. The toggle latch of claim 8, further comprising:
a spring for normally urging said safety catch into engagement with said housing.

11. The toggle latch of claim 8, further comprising:
said safety catch having a first cam surface thereon for engaging said tool and a second cam surface thereon for engaging said housing when said safety catch and said latch actuator are in the closed position, said first cam surface thus providing a visual indication of a latched condition.

12. The toggle latch of claim 8, further comprising:
said safety catch pivotally mounted within said latch actuator about said fourth pivot.

13. The toggle latch of claim 8, further comprising:
said latch actuator having an aperture therein to permit the insertion of a tool;
said aperture including a slot which pivotally mounts said safety catch; and
a spring for urging said safety catch from said slot into said aperture when in the latched position to provide a visual indication of said latched position.

14. In a toggle latch for retaining a first structure against a second structure, the toggle latch having a housing that pivotally mounts a latch actuator and a latch with a linkage joining said pivotable latch actuator and latch at further pivot points, one linkage pivot point going over-center from the other pivot points to form said toggle, the improvement comprising:
said latch actuator having a slotted aperture therein;
a safety catch mounted within said slotted aperture for locking said latch actuator in said over-center, latched position;
said slotted aperture configured to receive a tool for engaging and removing said safety catch from its locked position; and
said safety catch having a first cam surface thereon for engaging said tool and a second cam surface thereon for locking said latch actuator when in said latched position, said first cam surface providing a visual indication of said locked position of said safety catch.

* * * * *